US005085828A

United States Patent [19]

Shain et al.

[11] Patent Number: 5,085,828

[45] Date of Patent: Feb. 4, 1992

[54] COLD PRESS DIE LUBRICATION METHOD

[75] Inventors: Jon C. Shain, Anderson; James W. Herchenroeder, Fishers, both of Ind.

[73] Assignee: General Motors Corporation, Detroit, Mich.

[21] Appl. No.: 700,744

[22] Filed: May 15, 1991

[51] Int. Cl.[5] ..... G22F 1/00

[52] U.S. Cl. ..... 419/66; 419/10; 419/12; 75/244

[58] Field of Search ..... 419/66, 10, 12; 75/244

[56] References Cited

U.S. PATENT DOCUMENTS 3,993,824 11/1976 Shirahata et al. ..... 428/216
4,575,430 3/1986 Periard et al. ..... 252/12.6
4,616,796 10/1986 Inoue ..... 335/285
4,780,226 10/1988 Sheets et al. ..... 252/28
4,792,367 12/1988 Lee ..... 148/104
4,802,931 2/1989 Croat ..... 148/302
4,844,754 7/1989 Lee ..... 148/302
4,851,058 7/1989 Croat ..... 148/302
4,881,985 11/1989 Brewer et al. ..... 148/103
4,902,361 2/1990 Lee et al. ..... 148/302
4,978,398 12/1990 Iwasaki et al. ..... 148/101

*Primary Examiner*—Stephen J. Lechert, Jr.
*Attorney, Agent, or Firm*—George A. Grove

[57] ABSTRACT

A rare earth-containing powder is pressed into a compact at ambient temperatures using a solid lubricant applied only to the die wall and/or a core. The solid lubricant is applied by suspending lubricant powder in a fluorinated hydrocarbon liquid.

4 Claims, 2 Drawing Sheets

COLD PRESS DIE LUBRICATION METHOD

This invention pertains to practices for the hot pressing of rare earth element-containing powder alloys. More particularly, this invention pertains to a lubrication practice for forming a cold pressed compact to facilitate the hot pressing of such materials using open air presses.

BACKGROUND OF THE INVENTION

Rare earth element-containing alloys composed so as to form the $RE_2TM_{14}B$ tetragonal crystal phase have been melt spun under carefully controlled processing to produce useful permanent magnet materials as disclosed in Croat U.S. Pat. Nos. 4,802,931 and 4,851,058. Such melt-spun materials either as quenched or in an overquenched and annealed condition consist essentially and predominantly of the tetragonal crystal, prototype $Nd_2FE_{14}B$ phase. The tetragonal crystal-containing grains are very small, typically less than a few hundred nanometers on the average in grain size, and are surrounded by one or more secondary grain boundary phases which contribute to the permanent magnet characteristics of the composition. This fine grain material is magnetically isotropic, and the melt-spun ribbon fragments can be pulverized to a suitable powder, combined with a suitable binder material and molded into useful bonded isotropic permanent magnets as disclosed in Lee et al U.S. Pat. No. 4,902,361.

Where permanent magnets of higher energy product are desired, it is known that the melt-spun powder material can be hot pressed to form a fully densified permanent magnet body and that, where desired, such fully densified body can be further hot work deformed into a magnetically very strong, anisotropic magnet. These practices are disclosed, for example, in Lee U.S. Pat. Nos. 4,792,367 and 4,844,754.

The fine grain, melt-spun, rare earth element-containing material is initially in the form of ribbon particles or a powder produced by comminution of the ribbon fragments. In order to hot press or otherwise hot work the material, it is necessary that it be heated to a suitable hot working temperature typically in the range of 700° C. to 800° C. As disclosed by Lee, it is prudent to heat the powder in vacuum or suitable inert gas that provides a dry and substantially oxygen-free environment in order to prevent the powder from burning. In attempting to work with such readily oxidizable rare earth element-containing materials, it has been necessary to provide a suitable protective atmosphere in which the rare earth and other constituents are not oxidized and the permanent magnetic properties of the materials are not degraded.

In co-pending application attorney docket number G-6940, assigned to the assignee of this invention, is disclosed a two-step cold pressing-hot pressing process for producing hot pressed rare earth-transition metal-boron (RE-TM-B) magnets in an open-to-the-air press. In the first step of that process, fine grain RE-TM-B material in powder form is compacted at ambient temperature in open-to-the-air presses. The cold pressed compact that is formed has a density of about 5 to 5.5 grams per $cm^3$, which is about 70 percent of the density of a fully densified body of the same composition. In accordance with such two-step practice, the cold compacts are then suitably hot pressed in an open-to-the-air hot press in which the die cavity is heated and flooded with a dry inert gas such as argon to protect the compact from burning or other oxidation which would degrade the magnetic properties of the product.

The rare earth element-containing powder and cold pressed compact are susceptible to reaction with moisture and with certain chemical species such as the chloride ion. Therefore, in order to prevent chemical reaction of the constituents of the powder or the compact, it has been necessary to take precautions in addition to the use of dry inert gas during the hot pressing operation. For example, in the cold press-hot press practice referred to above, a lubricant is used in the cold pressing operation to facilitate compaction of the powder and removal of the compact from the die without abrasion of the die or the compact and without causing the compact to split apart. In order to accomplish this successful cold pressing, it was determined that a solid lubricant film, such as a film of polytetrafluoroethane or fluorinated ethylene-propylene copolymers (Teflon), should be applied to the die wall. No lubricant should be mixed with the powdered material added to the die for compaction. If the compact was to be ring shaped or the like and require a core piece as part of the press tooling, a film of solid lubricant could also be suitably applied to the surface of such core piece.

Teflon powder is a preferred solid lubricant film. The application of the powder to the die or core surface is accomplished using a suspension of Teflon in a volatile vehicle, preferably a liquid of relatively high density, so as to better suspend the Teflon powder particles. Volatile chlorine-fluorine containing aliphatic hydrocarbon liquids have been used in the above-described process to suspend the Teflon particles. However, some liquid remains in the lubricant film after drying and is transferred to the cold compact. In some operations, it is necessary or desirable to store cold compacts for hours or days before they are hot pressed. During such time, trace amounts of chlorine-containing liquids or other reactive liquids, particularly humid atmospheres, can react with the rare earth element-containing powder. Such reaction degrades the permanent magnet properties of the resultant product such a by reducing its coercivity.

Accordingly, it is an object of the present invention to provide a suitable liquid vehicle for suspending solid lubricant materials such as Teflon powder for die lubrication in the making of rare earth element-containing cold compacts for subsequent hot pressing.

BRIEF SUMMARY OF THE INVENTION

In accordance with preferred embodiments of our invention, the above and other objects are accomplished as follows.

The starting material for the practice of our invention is suitably a melt-spun ribbon particle or powder composition composed so as to ultimately form a magnet body consisting essentially of the tetragonal phase $RE_2TM_{14}B$ and a minor portion of a grain boundary phase(s) of higher rare earth element content. While RE stands for rare earth elements generally, it is preferred that the rare earth constituent of this material be made up of at least 60 percent of neodymium and/or praseodymium. The transition metal element (TM) is preferably iron or mixtures of iron with cobalt and/or with minor portions of other metals. This rapidly solidified starting material will suitably be of very fine grain size (e.g., less than 50 nm) or almost amorphous. The hot pressing process and any additional hot working process will then densify and work the material and simultaneously effect a growth in grain size such that the average grain size is larger but still less than about 500 nm in largest dimension. The product has useful permanent magnet properties.

The practice of our invention is suitably carried out in an open air press of the type having a die(s) with a die wall defining a die cavity of suitable cross-sectional configuration. In such presses, the workpiece material or body is inserted in the die cavity and compacted or worked by opposing machine members, typically lower and upper punches. In the operation of such a two-punch press, the upper punch is initially raised out of the die cavity and the lower punch is initially in a low position so as to open the cavity to receive the material to be worked. The upper punch is then lowered to close the cavity, and the two punches are then mechanically or hydraulically actuated so as to press and compact the workpiece material between them. The punches closely fit the die wall so as to confine the material being worked but are slightly spaced from the die wall so as to reduce friction and wear. After the material is compacted, the upper punch is raised out of the cavity and the lower punch is raised so as to elevate the compacted workpiece above the top edge of the die or so that the worked piece can be removed. This process is repeated on a more or less continuous basis.

In accordance with the broad context of our invention, a hot pressed, fully densified, permanent magnet body is produced in two pressing steps—a cold pressing step followed by a hot pressing step. Our invention is practiced in the cold pressing step.

Powder material of an above-described composition, in an amount based on the dimensions of the desired workpiece, is first compacted to a green compact at ambient temperature and in air. This pressing can be called cold pressing. The cold pressed compact suitably has a density of about five grams per cubic centimeter or higher, preferably about 5.3 to 5.5 grams per cubic centimeter. In this cold pressing operation, we form a film of a solid die lubricant, such as Teflon powder, on the die wall of the press. No lubricant or binder is mixed with the rare earth element-containing powder.

The Teflon or the like is preferably applied in the form of a liquid suspension of powder in a nonflammable, highly volatile liquid vehicle. In this regard, we prefer the use of fully fluorinated aliphatic hydrocarbons of about two to eight carbon atoms per molecule. The fluid Teflon-containing mixture is preferably applied to the die cavity wall through suitable small holes in the lower punch after the previously formed compact has been ejected from the die and the punch is being moved to its lowest position to receive the next charge of melt-spun powder. The upper punch is actuated to cold press the powder into a porous green compact. The dried die wall lubricant film facilitate the compaction and the removal of the compact from the die without damage to the die or compact.

After the green compact has been formed, it is then ready to be hot worked in another open air press. Usually, a different press is employed because it is adapted to heat the die to facilitate the hot pressing operation and requires heat-resistant tooling materials.

Some amount of liquid vehicle remains on the cold compacts. Presumably, this is due to the fact that no heat is applied to the press tooling and the pressing operation is carried out very rapidly. The solid lubricant film is not completely dried of the vehicle. Cold pressed parts may not be hot pressed immediately. Temporary storage of the compacts exposes them to both residual vehicle and moisture-laden air. By using suitable volatile fluorinated hydrocarbon liquids as a vehicle for the formation of our solid lubricant film, we are able to efficiently form rare earth-containing compacts that do not degrade on storage.

Other objects and advantages of our invention will become apparent from a detailed description thereof in which reference will be had to the drawings.

DETAILED DESCRIPTION

During the description of our process, we will refer to the drawings in which only a small portion of the press is depicted, namely that depicting the die and the upper and lower punches because it is in this region of the press that the special features of our process are involved. We illustrate a preferred embodiment of our invention in the making of a cold compact intended to be hot pressed into a sensor magnet in the shape of a circular right cylinder. However, it is to be understood that other magnet shapes can be produced by changing the die cross-section and punch shape. It is also to be understood that other press tooling constructions may be employed such as one punch anvil pressing, the pressing of ring shapes requiring cores, and the pressing of assemblies, i.e., magnets onto rotors or shunts, and the use of die shapes like shelf dies and step dies.

Figure 1B:
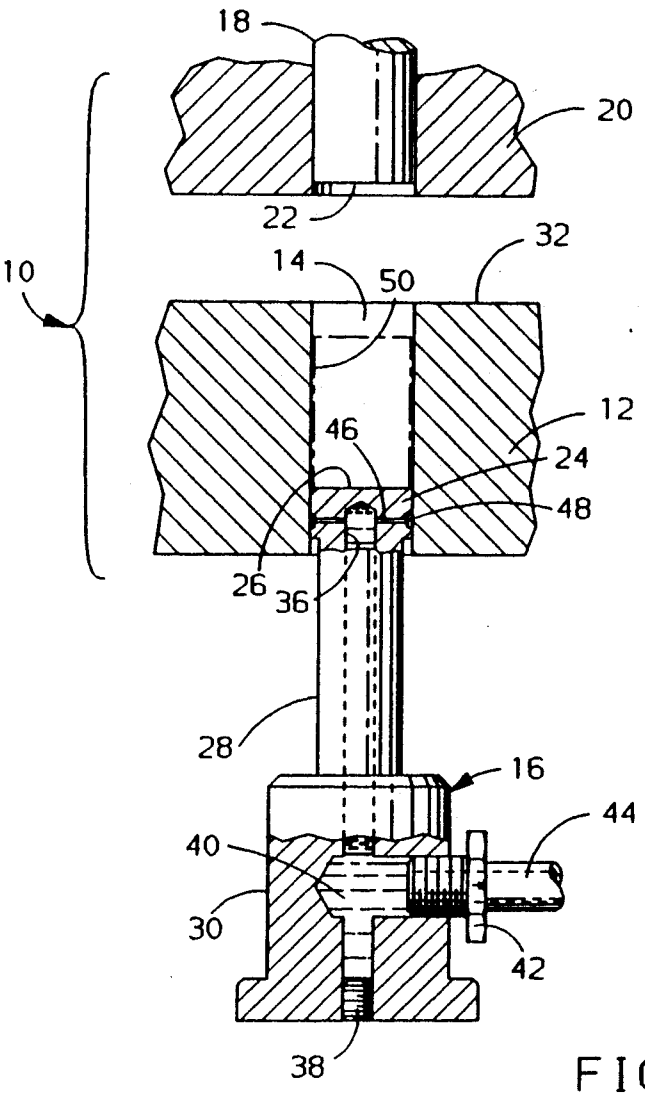
FIGS. 1*a* through 1*d* are schematic views, partly in section, of a cold forming, open air press illustrating the sequence of cold compact forming steps, including lubrication of the die cavity wall by spraying through the lower punch.
Figure 1A:
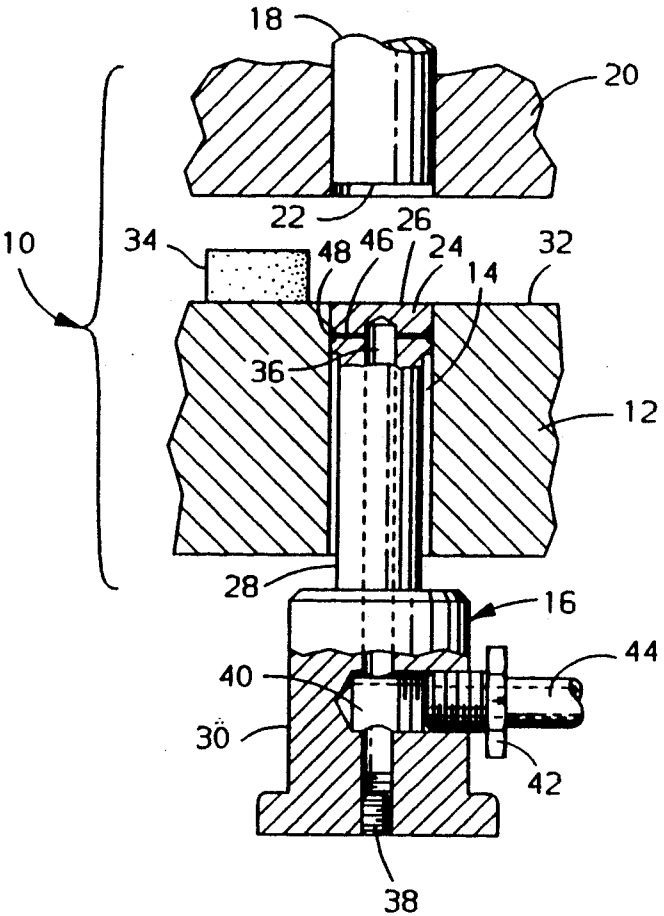
Figure 1D:
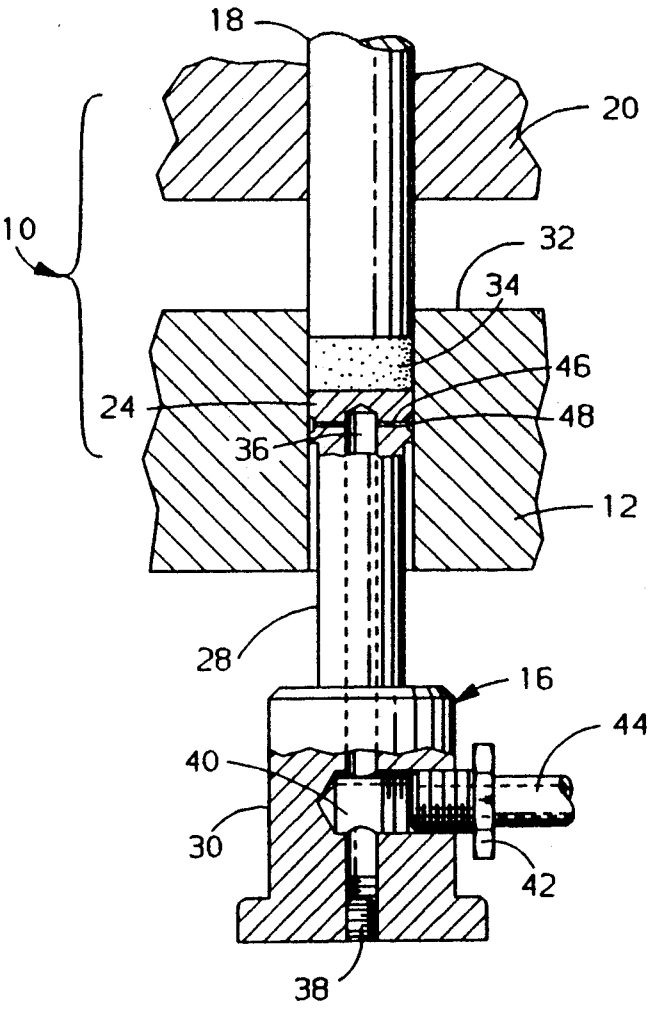
Figure 1C:
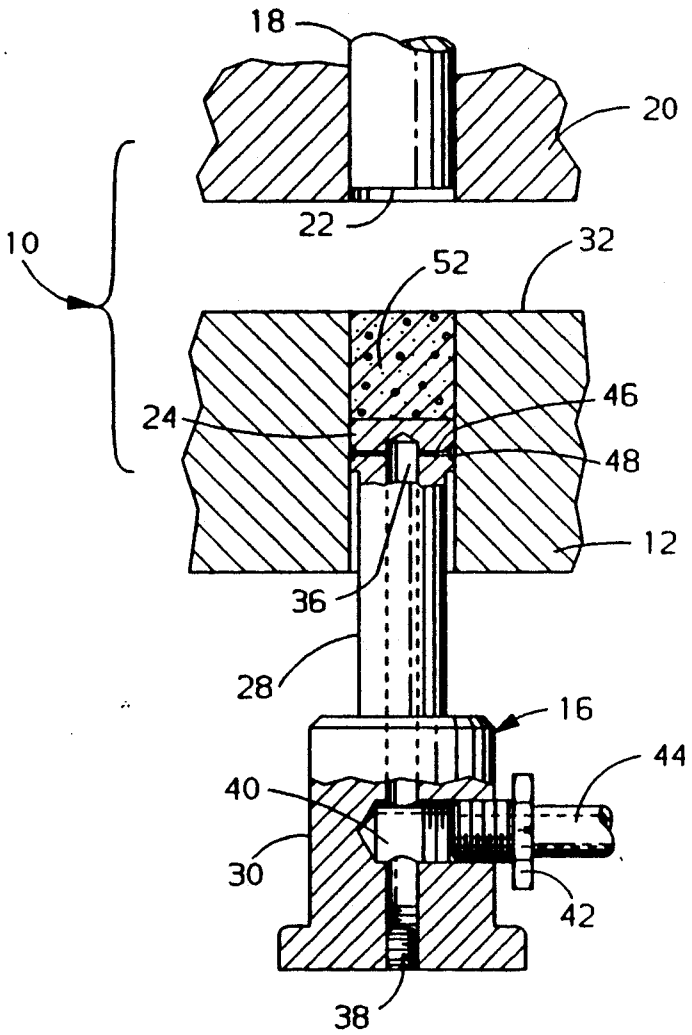

FIGS. 1*a* through 1*d* thus depict a small portion only of an open-to-the-air operable-at-ambient-conditions cold press 10. Cold press 10 has a die member 12 with a round cylindrical die cavity 14. Reciprocably operative in the die cavity 14 is a lower punch assembly 16. Also reciprocably operable in the die cavity is an upper punch 18. Upper punch 18 is slidably retained and guided by upper punch carrier 20. Upper punch 18 has a round, flat punch face 22. As shown in FIGS. 1*a* through 1*c*, upper punch 18 has been raised to its uppermost position to facilitate removal of a compacted product from the die of the cold press and the addition of a new particulate starting material.

Lower punch 16 comprises a head 24, with a flat face 26, that is circular in cross section and adapted to closely fit the wall of die cavity 14. The lower punch 16 comprises a smaller diameter shank portion 28. Lower punch 16 also includes an enlarged base 30 that is below the die block 12. As shown in FIG. 1*a*, the lower punch is elevated to its uppermost position with face 26 just flush with the upper surface 32 of die block 12. In this position, the lower punch has raised a just-formed cold compacted body of RE-TM-B particles 34. This cold compact member 34 has just been moved aside by a rake or other mechanical means (not shown) at the end of the compaction cycle of the press operation.

A typical such cold compact is a still slightly porous green compact of RE-TM-B particles of the type described above. It has a density in excess of 5 grams per cubic centimeter and is very useful in accordance with our process for the hot pressing and, if necessary, further hot working of this compact into a fully densified magnet body with exceptionally good permanent magnet properties.

Following the ejection of the cold compact body 34, lower punch 16 is then lowered to its lowest position (as shown in FIG. 1*b*) in the operation of the press. It is during this lowering process that this lower punch carries out an important part of the practice of our invention. Formed in lower punch 16 is a central axial hole 36 that extends from the base 30 of the punch 16 the length of the shank 28 of the punch and into the head 24. Axial hole 36 can be formed by drilling the hole through the base 30 up through the shank 28 into the head 24 and then closing off the outlet in the base with plug member 38. Plug member 38 is preferably flush with the bottom of the base member 30 so that the mechanically actuated press can operate on the bottom of the base to raise and lower the lower punch 16.

A transverse hole 40 is provided in the base member 30 that intersects axial hole 36. Hole 40 is threaded to receive fitting 42 and a supply tube 44 that is used for purposes that will soon be described. A small diameter second transverse hole 46 with respect to axial hole 36 is drilled in the head 24 of the punch. small hole or duct 46 extends diametrically across the head 24 of the punch and with outlets in a machined annular ring 48 that is parallel to the face 26 of the punch but slightly below it at the upper end of axial passage 36. Thus, lower punch 16 contains a continuous internal passage leading from tube 44 into cross duct 40 through axial duct 36 to the small outlet duct 46 in the head 24 of the punch. The purpose of this passage is to supply a suitable lubricant to the wall surface of die cavity 14.

We prefer the use of a Teflon lubricant film. Teflon particles are applied by the use of a liquid carrier or vehicle. The mixture is suitably about 90 percent by volume liquid vehicle and 10 percent by volume Teflon particles. The liquid is a material that can suspend the Teflon particles if the mixture is agitated and carry them through the tube and ductwork of the lower punch. The vehicle must also be a material that will readily vaporize from the wall of the die.

A suitable vehicle for use in our invention is a fully fluorinated derivative of an aliphatic hydrocarbon, preferably a hydrocarbon of 2 to 8 carbon atoms in the molecule. A perfluorinated hexane or octane is suitable. These molecules may be in the form of either molecular chains or the cyclo compounds. We prefer to use perfluorinated hexane.

Thus, a mixture of about 90 percent by volume liquid fluorocarbon and 10 percent by volume Teflon powder is mixed and prepared in a separate container not shown in the drawings. The mixture is agitated and then delivered from the container through tube 44 and ducts 40, 36 and 46 to the die cavity wall 14 of die 12. The container or delivery system not shown is adapted to supply the fluid under pressure as required.

Referring now to FIGS. 1*a* and 1*b*, the lubricant mixture is pressurized at the time that the lower punch is at its uppermost point as depicted in FIG. 1*a*. As the lower punch is lowered in the die cavity until it reaches its position in FIG. 1*b*, pressure is applied to the fluid and a coating film 50 of the fluid is applied to the cavity wall 14 of the die as depicted in FIG. 1*b*. The vehicle vaporizes very rapidly although there is a residual amount. Another important feature of our invention requiring the use of the perfluorinated compound is the fact that this material, if it remains on the surface of the cold compact, does not adversely affect the permanent magnet properties of the body during any storage or hot pressing.

Thus, with the lower punch 16 in its down position and the upper punch 18 in its upper position and the lubricant film applied to the wall of the die cavity (FIG. 1*b*), the cavity 14 is now ready to receive the powdered, rapidly solidified iron-neodymium-boron type material. The lower punch 16 is raised to a fill position (FIG. 1*c*) determined by the volume of powder to be added. The material is loaded into the lower die in loose particulate form. It is dropped into the die from a hopper not shown, and it is measured by any suitable method into the die cavity. As seen in FIG. 1*c*, the powdered material 52 is now in the die.

The upper punch then comes down and the two punches and die wall cooperate for the consolidation of the powder into the green compact 34. FIG. 1*d* illustrates the position of the upper and lower punches at the time that the particles have been consolidated into the green compact 34.

As soon as the compaction has been completed, the upper punch is raised out of the way to its upper position as depicted in FIG. 1*a*, the lower punch is raised to eject the compact from the die, the compact is removed, and the process is repeated. This cold compaction process typically requires about one to six seconds per cycle and is carried out at ambient conditions. The cold compact will likely have a trace of Teflon powder on its outer surfaces. It will have a trace of the fluorinated vehicle. However, the composition of the vehicle is such that it does not adversely affect the permanent magnet properties of the iron-neodymium type material, even though the compact is stored in air before hot pressing.

While our practice has been described in terms of a few specific embodiments thereof, it will be appreciated that other forms of our invention could readily be adapted by those skilled in the art. As described, the lubricant film was formed by spray through one of the press punches. Obviously, the fluorinated liquid-powder mixture can be applied by other spray techniques, by wiping or the like. Accordingly, the scope of our invention is to be considered limited only by the following claims.

The embodiments of the invention in which an exclusive property or privilege is claimed are defined as follows:

1. In the method of cold pressing a rare earth element-containing alloy powder of $RE_2TM_{14}B$ precursor composition into a compacted body, preparatory to a hot working operation on the compacted body, utilizing an open-to-the-air press of the type comprising at least one die member defining a material-receiving die cavity with a die wall and opposing pressing members, at least one of which is adapted to move reciprocally in the die cavity, to compress material placed there, said method comprising applying a solid lubricant film to the cavity-defining wall which is at substantially ambient temperature, charging a predetermined quantity of a lubricant- and binder-free rare earth element-containing alloy powder to the lubricated cavity, consolidating the powder in the die cavity by pressing member action at ambient temperature to form a green compact of generally self-sustaining strength and a density of about five grams per cubic centimeter or higher, the improvement where the solid lubricant is applied as a suspension of solid lubricant particles in a volatile, chlorine-free, fluorinated hydrocarbon liquid.

2. In the method of cold pressing a rare earth element-containing powder alloy of $RE_2TM_{14}B$ precursor composition into a compact body, preparatory to a hot working operation on the compact body, utilizing an open-to-the-air press of the type comprising a die member defining a material-receiving die cavity with a die wall defining a predetermined cross-sectional configuration and upper and lower opposing punches adapted to move reciprocally in the die cavity to compress material placed there, said method comprising applying a solid lubricant film to the cavity-defining wall of a die which is at substantially ambient temperature, charging a predetermined quantity of a lubricant- and binder-free rare earth element-containing metal alloy powder to the lubricated cavity onto the lower punch, and consolidating the powder in the die by punch action at ambient temperature to form a green compact of generally self-sustaining strength and a density of about five grams per cubic centimeter or higher, the improvement where the solid lubricant is applied by suspending solid lubricant particles in a liquid consisting essentially of a fully fluorinated aliphatic hydrocarbon of two to eight carbon atoms and spraying the mixture onto the die wall.

3. A method as recited in claim 1 in which the solid lubricant is applied to the die wall of the ambient temperature press by spraying Teflon particles dispersed in the fluorinated hydrocarbon liquid through a duct in the lower punch.

4. A method as recited in claim 2 in which the solid lubricant is applied to the die wall of the ambient temperature press by spraying Teflon particles dispersed in the fluorinated hydrocarbon liquid through a duct in the lower punch.

* * * * *